United States Patent [19]

Monsarrat

[11] 4,431,373

[45] Feb. 14, 1984

[54] FLOW DIRECTING ASSEMBLY FOR A GAS TURBINE ENGINE

[75] Inventor: William G. Monsarrat, South Windsor, Conn.

[73] Assignee: United Technologies Corporation, Hartford, Conn.

[21] Appl. No.: 150,490

[22] Filed: May 16, 1980

[51] Int. Cl.[3] ..... F04D 29/54

[52] U.S. Cl. ..... 415/189; 415/199.5; 415/218

[58] Field of Search ..... 415/136, 138, 139, 189, 415/193, 218, 217, 199.5, 190; 60/39.31, 39.32

[56] References Cited

U.S. PATENT DOCUMENTS

| | | | |
|---|---|---|---|
| 1,680,737 | 8/1928 | Hodgkinson | 415/138 |
| 1,692,537 | 11/1928 | Baumann | 415/136 |
| 2,472,062 | 6/1949 | Boestad et al. | 415/139 |
| 2,749,026 | 6/1956 | Hasbrouck et al. | 415/194 x |
| 2,766,963 | 10/1956 | Zimmerman | 415/218 |
| 2,915,281 | 12/1959 | Ridley et al. | 415/218 |
| 3,423,071 | 1/1969 | Noren | 415/217 |
| 3,986,789 | 10/1976 | Pask | 415/139 x |
| 3,997,280 | 12/1976 | Germain | 415/189 |
| 4,251,185 | 2/1981 | Karstensen | 415/136 |

FOREIGN PATENT DOCUMENTS

| | | | |
|---|---|---|---|
| 412623 | 4/1925 | Fed. Rep. of Germany | 415/199.5 |
| 818387 | 9/1937 | France | 415/199.5 |
| 920039 | 3/1947 | France | 415/189 |

*Primary Examiner*—Leonard E. Smith

*Attorney, Agent, or Firm*—Gene D. Fleischhauer

[57] ABSTRACT

A nonrotating flow directing assembly 14 for a gas turbine engine is disclosed. The flow directing assembly is formed of a circumferentially segmented inner case 24 supported by an annular sleeve 22. The inner case 24 is formed of a plurality of arcuate segments 26 extending axially continuously through the engine. A method of assembling the circumferentially continuous annular sleeve about an axially continuous rotor is also disclosed. In an alternate embodiment the inner case 124 is formed of several pluralities of arcuate segments 126.

11 Claims, 7 Drawing Figures

FLOW DIRECTING ASSEMBLY FOR A GAS TURBINE ENGINE

The Government has rights in this invention pursuant to Contract No. NAS 3-20646 awarded by the National Aeronautics and Space Administration.

DESCRIPTION

1. Technical Field

This invention relates to axial flow rotary machines, and more particularly to flow directing assemblies of the nonrotating type, such as the stator assemblies of gas turbine engines having arrays of stator vanes in the compression section or the turbine section of such an engine.

2. Background Art

In the compression section of a gas turbine engine, a rotor structure extends axially through the compression section. A stator structure is spaced radially from the rotor structure and circumscribes the rotor structure. Arrays of rotor blades extend outwardly from the rotor structure into proximity with the stator structure. Arrays of stator vanes extend inwardly from the stator structure into proximity with the rotor structure. A flow path for working medium gases extends axially through the compression section between the rotor structure and the stator structure.

An example of such a construction is shown in U.S. Pat. No. 4,019,320 entitled "External Gas Turbine Engine Cooling For Clearance Control" issued to Redinger, Jr. et al. In this construction, the stator vanes and axially discrete outer air seals are supported from an outer case. The outer case has circumferentially extending flanges which are bolted together during assembly. The hoop strength of these circumferentially continuous flanges aids the outer case in maintaining a true, circular shape during operative conditions which subject the case to thermal growth and internal pressure.

In some modern engines, the rotor assembly is comprised of a rotor drum and rotor blades. The rotor drum is axially continuous. To assemble the stator vanes about such a rotor drum, the outer case of the stator structure is axially split and provided with axially extending flanges which are bolted together during assembly. An example of such a construction is shown in U.S. Pat. No. 2,848,156 issued to Oppenheimer entitled "Fixed Stator Vane Assemblies". Drum rotors are used because of their light weight as compared with bolted up constructions, better fatigue life through the elimination of axially extending bolt holes, and the higher critical speed margin resulting from their axial stiffness.

DISCLOSURE OF INVENTION

According to the present invention, a longitudinally split inner case carrying arrays of stator vanes is supported by a circumferentially continuous outer sleeve circumscribing the longitudinally split inner case.

In accordance with the present invention, vanes of a stator assembly are assembled in a plurality of arcuate segments disposed about the rotor assembly; an annular sleeve is slid over the arcuate segments to hold the segments in place.

A primary feature of the invention is a longitudinally split inner case which is formed of a plurality of arcuate segments. Each segment of the inner case is axially continuous. Each segment of the inner case engages a portion of more than one array of stator vanes. Another feature is an annular sleeve which is circumferentially continuous. The annular sleeve holds the inner case in circumferential alignment. Another feature is the means for engagement between the inner case and the annular sleeve permitting the annular sleeve and the inner case to be slidably assembled with respect to each other. In one embodiment the inner case is made up of more than one plurality of axially continuous segments.

A principal advantage of the present invention is the ease with which stator components can be assembled about a rotor. An increase in engine efficiency results from the true circularity of the circumferentially continuous annular sleeve which positions the inner case about the rotor structure. Another advantage is the increased efficiency which results from the aerodynamic smoothness of the axially continuous flow path as compared with constructions having a multiplicity of rings each of which extends at a slightly different diameter into the working medium flow path. The efficiency of the engine is increased by the close correspondence between the rotor structure and the stator structure enabled by the free acting radial inward and outward movement of the segmented inner case which is supported from the outer sleeve.

Other features and advantages will be apparent from the specification and claims and from the accompanying drawings which illustrate an embodiment of the invention.

BEST MODE FOR CARRYING OUT THE INVENTION

Figure 1:
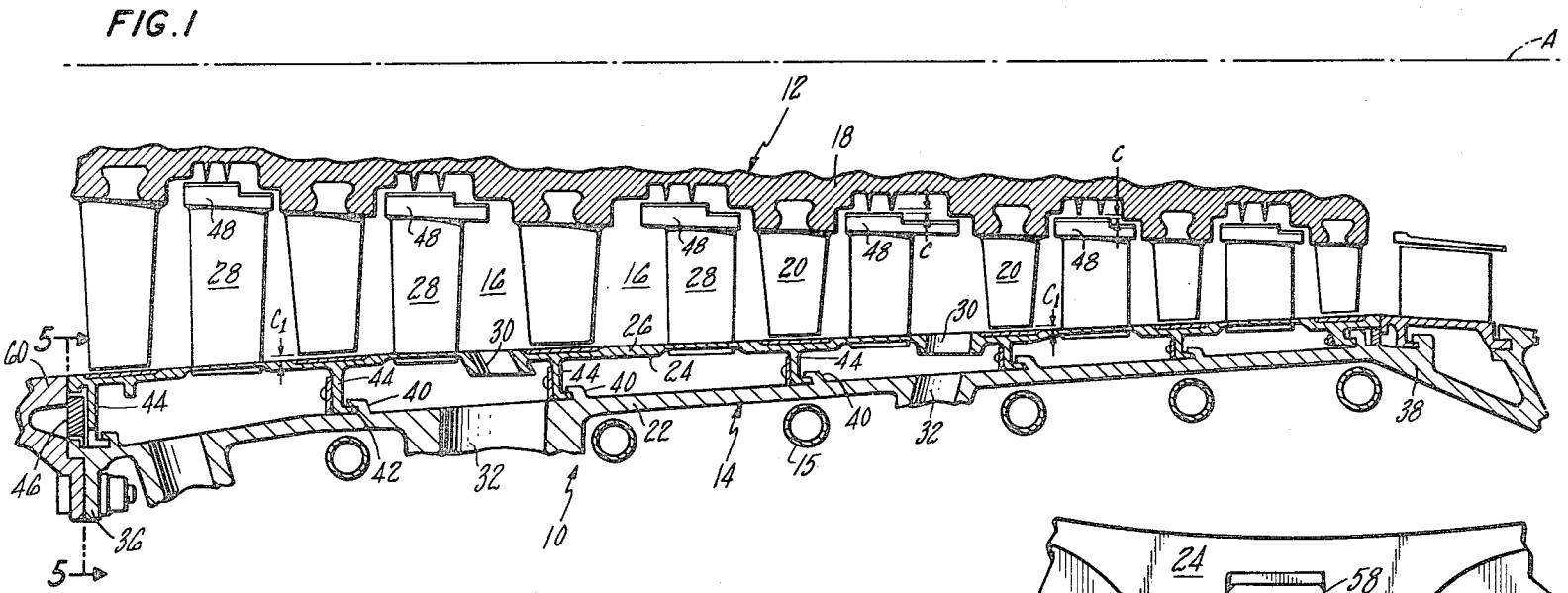
FIG. 1 is cross-section view of a compression section of a gas turbine engine showing an annular sleeve supporting an inner case.

A gas turbine engine embodiment of the invention is illustrated in FIG. 1. A portion of a compression section 10 of such an engine is shown. The compression section includes a flow directing assembly which rotates about an axis A of the engine such as the rotor assembly 12 and a flow directing assembly which does not rotate such as the stator assembly 14 circumscribing the rotor assembly. As will be appreciated, use of these flow directing assemblies is equally applicable to the turbine section of such an engine. A plurality of external tubes 15 for cooling air circumscribe the stator assembly. An annular flow path 16 for working medium gases extends axially through the engine between the stator assembly and the rotor assembly. The rotor assembly includes a rotor 18. A drum rotor type construction is shown. This invention has particular utility when used in conjunction with such rotor constructions, although the concepts are applicable to bolted-up rotors having individual rotor disks as well. The rotor assembly includes arrays of rotor blades extending outwardly from the rotor as represented by the single rotor blades 20.

Figure 7:
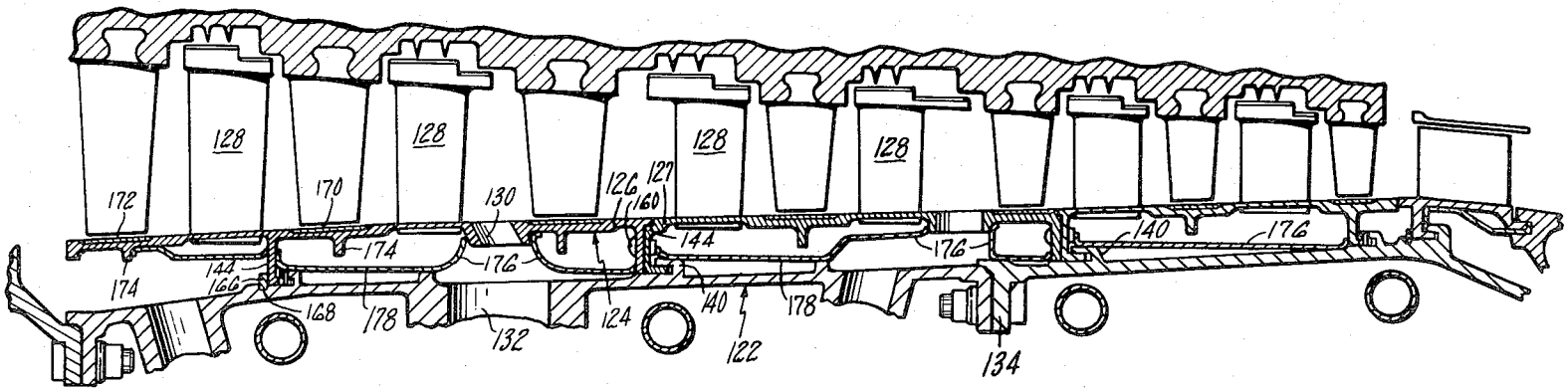
FIG. 7 is a cross-section view of an alternate embodiment corresponding to the FIG. 1 view.

The stator assembly 14 is formed of an annular sleeve 22 and an inner case 24. The inner case extends axially in the engine outwardly of the annular flow path 16 for working medium gases. The inner case is formed of a plurality of arcuate segments 26 circumferentially adjacent one to another. The arcuate segments are axially continuous. Each arcuate segment supports a portion of the vanes of two or more arrays of stator vanes as represented by the single vanes 28. The expression "axially continuous" denotes a structure unsplit in the circumferential direction. The annular sleeve is outwardly of the inner case and engages the segments of the inner case. The annular sleeve is formed of circumferentially continuous material. As used in this application "continuous material" is defined as material uninterrupted by a split. For example, axially continuous material is material uninterrupted by a circumferentially extending split. Circumferentially continuous material is material uninterrupted by an axially oriented split. Thus, even though the inner case 24 is interrupted by a bleed hole 30 and the annular sleeve is interrupted by a bleed hole 32, the segments of the inner case are deemed to be formed of axially continuous material and the annular sleeve is formed of circumferentially continuous material as shown in FIG. 1. As will be realized, the annular sleeve 22 may be formed of axially continuous material or may have a plurality of circumferentially extending flanges 34 which are bolted together as shown in FIG. 7.

The annular sleeve 22 has a large diameter end 36 and a small diameter end 38. The sleeve has a means for holding the segments in circumferential alignment such as a plurality of flanges 40 extending circumferentially about the interior of the case. Each flange has a groove 42 facing the large diameter end. Each segment of the inner case includes a plurality of flanges 44, each flange extending circumferentially about the segment and extending outwardly to slidably engage in a circumferential direction a corresponding flange of the sleeve. Each flange on the inner case extends axially into one of the grooves towards the small diameter end of the annular sleeve. Each flange on the sleeve is radially outward of any flange on the inner case which is disposed entirely between the flange on the sleeve and the small diameter end of the sleeve.

A means for preventing rotative movement between an inner structure, such as the inner case 24, and an outer sleeve, such as the annular sleeve 22, extends between the inner case and the outer sleeve at the large diameter end and the small diameter end of the annular sleeve. In this embodiment, the means is a splined ring 46 discussed infra and illustrated in FIG. 5.

A plurality of shroud rings 48 extend circumferentially about the interior of the engine. The shroud rings are inward of the annular flow path 16 for working medium gases and spaced radially by a clearance gap C from the rotor 18.

Figure 2:
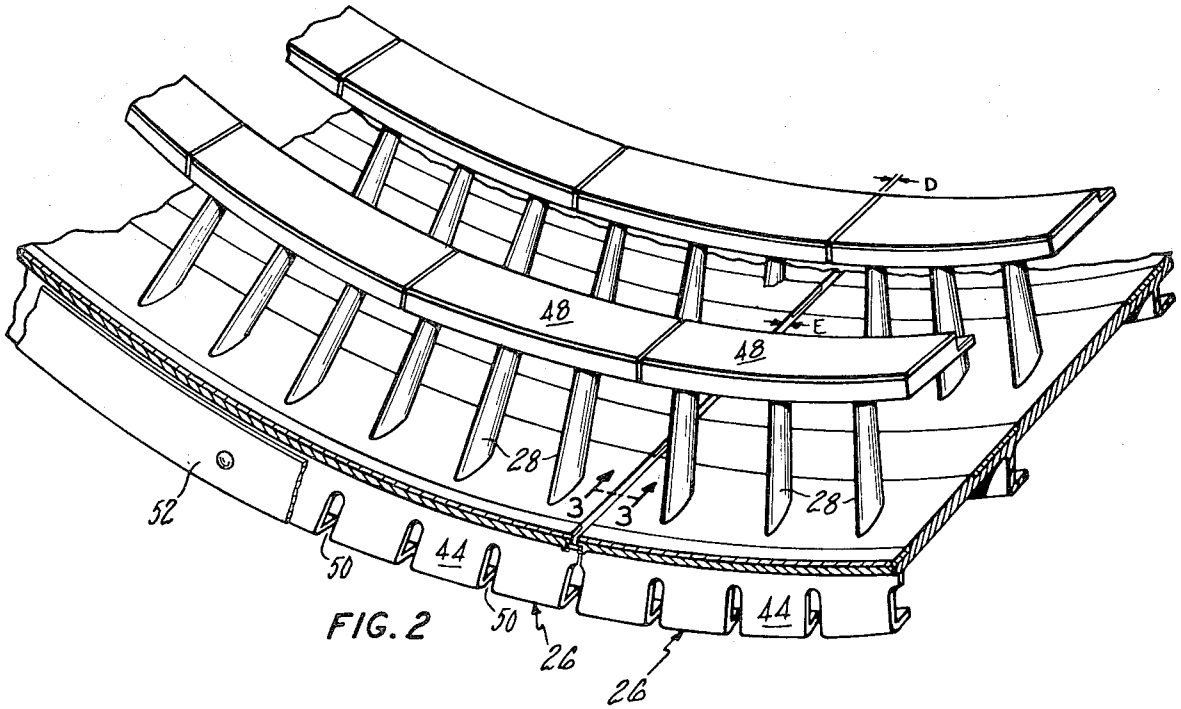
FIG. 2 is a partial perspective view of two adjacent arcuate segments of the inner case.

FIG. 2 is a partial perspective view of a portion of two of the arcuate segments 26 of the inner case and shows the array of stator vanes 28, the shroud rings 48 and the flanges 44. Each flange 44 of the inner case has gaps 50 interrupting the circumferential continuity of the flange. A thin, sheet metal shield 52 blocks the working medium gases from flowing through the gaps.

Each shroud ring 48 engages a corresponding array of stator vanes. Each shroud ring is segmented and each segment of the shroud ring engages a plurality of vanes. As will be appreciated, "plurality" is intended to embrace any number in excess of one. In the embodiment shown, each segment of the shroud ring engages the inward ends of three vanes extending inwardly from a single arcuate segment 26 of the inner case 24. Each segment of the shroud ring is spaced circumferentially from the adjacent segment leaving a gap D therebetween. The arcuate segments of the inner case are circumferentially adjacent and spaced one from another leaving a gap E therebetween.

Figure 3:
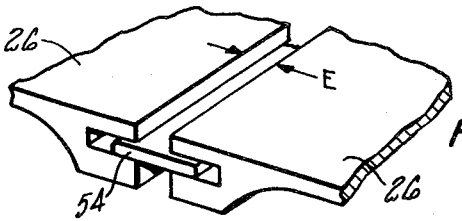
FIG. 3 is a sectional view taken along the lines 3—3 of FIG. 2.
Figure 4:
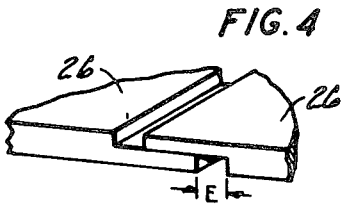
FIG. 4 is a sectional view of an alternate embodiment corresponding to the FIG. 3 view.

As shown in FIG. 3, means for sealing such as feather seal 54 extends circumferentially between the adjacent arcuate segments of the inner case. As will be appreciated the segments of the inner case might circumferentially overlap each other to provide sealing. Such a construction is shown in FIG. 4.

Figure 5:
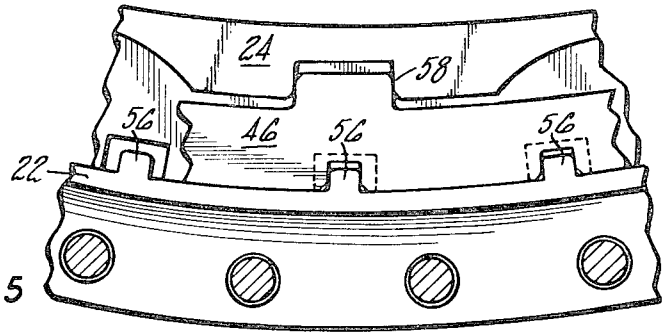
FIG. 5 is a sectional view taken along the lines 5—5 of FIG. 1 with a portion of the annular sleeve, the anti-rotative ring and an arcuate segment of the inner case broken away.

FIG. 5 shows a portion of the splined ring 46, the inner case 24 and the annular sleeve 22. The ring engages the annular sleeve at a plurality of spline-type connections 56 and engages an arcuate segment 26 of the inner case at an inner spline-type connection 58. The circumferential portions of the arcuate segment on either side of the inner spline-type connection are free to move circumferentially with respect to the sleeve. As shown in FIG. 1 an upstream case 60 and a flange 44 on the inner case trap the ring in the axial direction. The ring may be circumferentially continuous or formed of a plurality of segments. As will be realized, other means for preventing rotative movement between an inner structure and an outer sleeve may be used such as a radial pin in flange 140 and a slot in flange 144.

Figure 6:
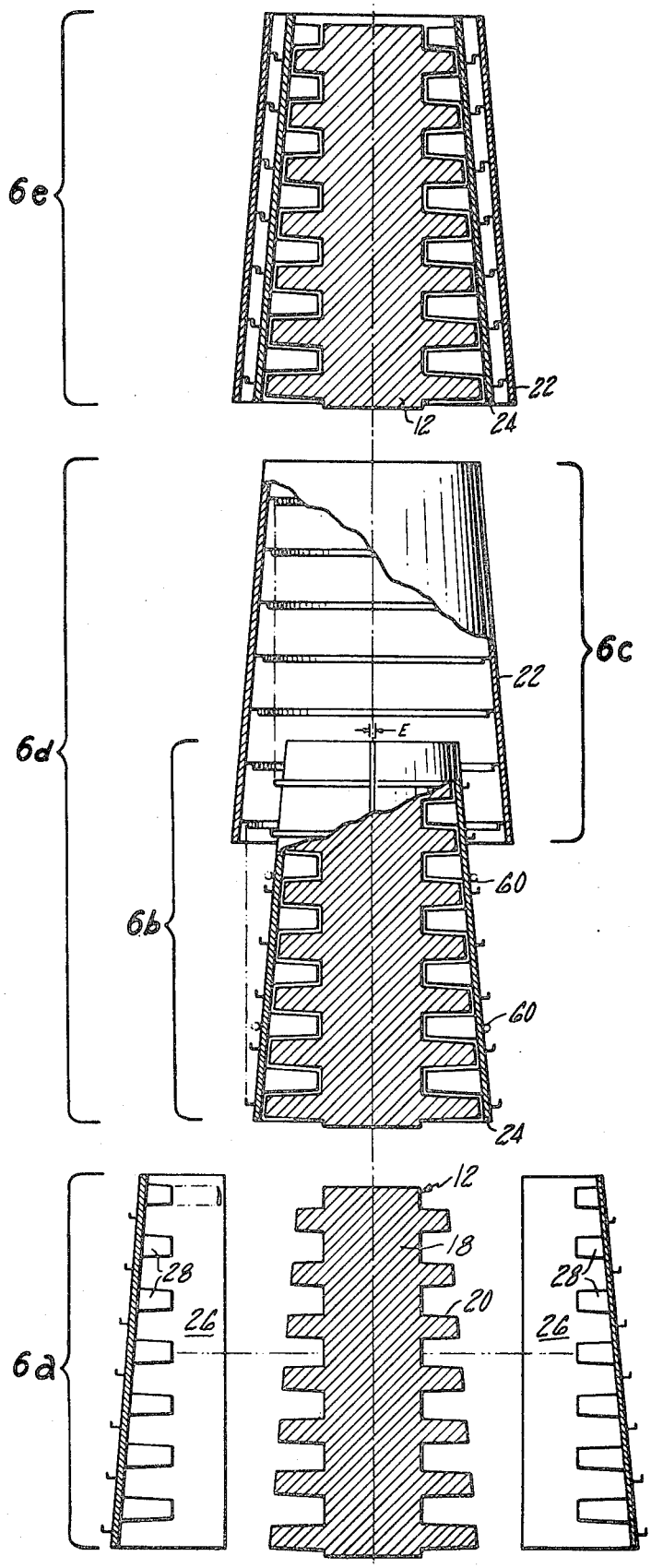
FIG. 6 is a diagrammatic illustration of the method of assembly of the flow directing assembly.

FIG. 6 is a diagrammatic illustration of a portion of the compression section illustrating a fundamentally new method of constructing a stator assembly about a rotor.

FIG. 6*a* illustrates the first step of forming the rotor assembly 12. The rotor assembly includes a rotor 18. The rotor may be of a drum rotor type or a bolted-up construction of individual disks and spacers. A drum rotor is illustrated. Arrays of rotor blades 20 are assembled to the rotor and extend outwardly from the rotor. Each array of rotor blades is spaced axially from the adjacent array of rotor blades leaving an axial space therebetween.

FIG. 6*a* shows the step of forming an inner case 24 of at least two arcuate segments 26 extending longitudinally. In the diagrammatic illustration, two arcuate segments are shown. Two or more arrays of stator vanes 28 are assembled to each segment. The stator vanes of each segment extend inwardly from the arcuate segment. The vanes of the arrays of stator vanes are spaced axially one from another leaving an axial space therebetween.

FIG. 6*a* illustrates the step of positioning each arcuate segment 26 of the inner case radially outwardly of the rotor assembly 12 such that the arcuate segments are circumferentially spaced one from another. The arrays of stator vanes are each aligned in opposing relationship to a corresponding axial space between the arrays of rotor blades and the arrays of rotor blades are each aligned in opposing relationship to a corresponding space between the arrays of stator vanes.

FIG. 6*b* shows the completion of the step of assembling the inner case to the rotor assembly by moving the arcuate segments 26 of the inner case inwardly toward the longitudinal axis of the rotor assembly such that the arrays of rotor blades and the arrays of stator vanes are interdigitated. As will be appreciated, the segments of the inner case may be circumferentially spaced one from another by a predetermined distance E.

Assembling a vertically oriented inner case 24 to a vertically oriented rotor assembly 12 obviates the need for ties to keep the inner case in the assembled position. Assembling a horizontally oriented inner case to a horizontally oriented rotor assembly might require circumferentially extending ties such as cotton string and shims to maintain the required clearance E. The string 60 is shown in phantom.

FIG. 6*c* illustrates the step of forming an annular sleeve having a longitudinal axis of symmetry.

FIG. 6*d* shows the step of assembling the annular sleeve 22 to the arcuate segments 26 of the inner case 24 and the rotor assembly 12. The step includes aligning the axis of symmetry of the rotor assembly with the axis of symmetry of the sleeve and causing relative movement between the sleeve and the inner case such that the sleeve slidably engages each segment of the inner case.

FIG. 6*e* shows the assembled rotor assembly 12, the inner case 24 and the annular sleeve 22.

FIG. 7 is an alternate embodiment of FIG. 1 showing an inner case 124 formed of at least two pluralities of arcuate segments which are axially continuous. The inner case includes a first plurality of arcuate segments 126 circumferentially adjacent one to another. Each arcuate segment is axially continuous. Each arcuate segment supports a portion of at least two arrays of stator vanes 128. And, the inner case includes a second plurality of arcuate segments 127 circumferentially adjacent one to another. Each arcuate segment 127 abuts a corresponding arcuate segment 126 of the first plurality of arcuate segments. Each arcuate segment 127 supports a portion of not less than two arrays of stator vanes. An annular sleeve 122 of circumferentially continuous material outwardly of the inner case engages the arcuate segments 126, 127 of the inner case to hold the segments in circumferential alignment.

Each of the first plurality of arcuate segments 126 is integrally attached to a corresponding segment 127 of the second plurality of arcuate segments. The segments may be attached, for example, by rivets 160 or by other suitable fastening means such as a plurality of bolt and nut assemblies. The annular sleeve 122 which circumscribes the arcuate segments has a plurality of flanges 140 spaced axially one from another. The flanges extend circumferentially about the interior of the annular sleeve. Each arcuate segment 126, 127 of the inner case includes at least one flange 144, each flange extending circumferentially about the arcuate segment and extending outwardly to slidably engage in the circumferential direction a corresponding flange of the sleeve. In the embodiment shown, each of the first plurality of arcuate segments 126 is integrally attached to a corresponding segment at a flange 144 of an arcuate segment. A means for axial retention such as the snap ring 166 engages a groove 168 in the outer case. The snap ring abuttingly engages an upstream flange on each segment of the inner case such as flange 144.

Each arcuate segment of the inner case 126, 127 has a plurality of rubstrips as represented by the single rubstrip 170 and the single rubstrip 172. Each segment has a plurality of flanges 174 for reinforcement. Each flange extends outwardly from a corresponding segment and is outward of the rubstrip.

The inner case 124 has at least one bleed opening 130 for working medium gases. The annular sleeve 122 has a corresponding bleed opening 132 for working medium gases in gas communication with the bleed opening in the inner case. At least one seal member 176 extends circumferentially about the inner case and is disposed between the bleed openings and a flange 144 of the inner case. The seal member is formed of a plurality of arcuate seal segments 178, each seal segment engaging an arcuate segment of the inner case, such as arcuate segment 126 or arcuate segment 127, and extending outwardly into proximity with the annular sleeve 122.

During operation of a gas turbine engine, as shown in FIG. 1, working medium gases are flowed along the flow path 12 for working medium gases. The gases pass through the arrays of stator vanes 28 and rotor blades 20. The rotor assembly 12 and the stator assembly 14 confine the working medium gases to the flow path. In particular, the clearance gap C between the rotor assembly and the stator assembly is small enough to block the leakage of working medium gases past the inward ends of the stator vanes and the outward ends of the rotor blades.

The operative temperatures of these assemblies and the rotational forces acting on the rotor assembly 12 cause relative movement between the stator assembly 14 and the rotor assembly. In some cases this relative movement increases the clearance gap C between the rotor assembly and the stator assembly. Cooling air is flowed through the external tubes 15 to impinge on the annular sleeve 22 of the stator assembly. The cooling air removes heat from the annular sleeve causing the sleeve to contract and move inwardly. The ends of the arcuate segments 26 on either side of the inner spline-type connection 56 are free to slide circumferentially with respect to the annular sleeve. As the annular sleeve moves inwardly, the annular sleeve forces the inner case to a smaller diameter decreasing the clearance gap C between the rotating assembly and the stator assembly. Decreasing the clearance gap decreases the penalty to aerodynamic efficiency caused by leakage of the working medium gases through the clearance gap.

The inner case 24 being formed of circumferentially adjacent arcuate segments 26 has reduced hoop strength as compared with circumferentially continuous cases. The gaps 50 in the flanges 44 extending between the inner case and the annular sleeve further reduce the hoop strength of the inner case. Similarly, the shroud ring 48 is segmented to reduce the hoop strength of the shroud ring. The reduction in hoop strength of the shroud ring and the arcuate segments reduces the retardant effect of the inner case on the thermal response of the annular sleeve.

As the working medium gases pass through the arrays of stator vanes 28, the gases exert a circumferential force on the stator vanes. The shroud ring 48 engages the inward ends of a plurality of the vanes and together with an arcuate segment 26, supports the vanes against this force in guided cantilevered fashion. This circumferential force is transmitted outwardly through the vanes, the arcuate segments 26 of the inner case, and the splined ring 46 to the annular sleeve 22. Because the splined ring is free to move in the radial direction, bending forces on the arcuate segment of the inner case are not increased by the radial moment arm of the ring acting circumferentially on the inner case. Thus, the spline ring avoids the moment arm and the associated forces which would exist if the ring were integrally attached to the inner case. Accordingly, the splined ring avoids inducing the circumferential distortion in the arcuate segments which is associated with such bending forces.

The axial continuity of the inner case 24 and the circumferential continuity of the annular sleeve 22 have advantages which are not found together in the prior art. The axially continuous arcuate segments 26 of the inner case bound the annular flow path 16 with an aerodynamically smooth surface in the axial direction. This decreases flow losses caused by small projections into the flow path associated with structures built up of a multiplicity of circumferential rings extending into the flow path from the stator structure. Because the annular sleeve is circumferentially continuous, the annular sleeve is not split and avoids the need for axially oriented flanges. These axial flanges are required for split case constructions and are particularly helpful for drum rotor constructions. However, the flanges cause the outer case to be structurally stiff in the vicinity of the flange. Structural stiffness affects the radial growth of the outer sleeve and results in ovalization of the sleeve. Because of outer sleeve is circumferentially continuous and does not have these flanges, the case is not subject to ovalization as a result of those flanges and avoids variations in the clearance gap C between the rotor assembly and the stator assembly.

In a similar fashion, the inner case 124 shown in FIG. 7 is segmented to permit inward and outward movement of the inner case in response to changes in diameter of the annular sleeve 122. As will be realized, the annular sleeve may be axially continuous as well as circumferentially continuous. In the embodiment shown the annular sleeve is circumferentially continuous and has a first annular sleeve and a second annular sleeve which are integrally secured to each other. Such a circumferentially extending flange does not introduce an axial extending discontinuity as does the axially extending flange of split cases. The seal members 176 block the working medium gases from contacting the flanges 144 as the gases proceed from the bleed opening 130 in the inner case to the bleed opening 142 in the annular sleeve.

One flange 144 on each first arcuate segment engages a corresponding flange 140 on the annular sleeve. Each first arcuate segment 126 is also integrally attached to a flange 144 of a corresponding adjacent second arcuate segment 127. The flange 144 on the second arcuate segment 127 supports the arcuate segment 126 from the annular sleeve. By joining the segment from the first plurality of arcuate segments to the adjacent segment of the second plurality of arcuate segments at the flange, the chance for a flow path discontinuity is minimized because both segments are positioned by the same flange 140 on the annular sleeve 122.

Although this invention has been shown and described with respect to a preferred embodiment thereof, it should be understood by those skilled in the art that various changes and omissions in the form and detail thereof may be made therein without departing from the spirit and scope of the invention.

I claim:

1. A method for fabricating a flow directing device formed of a stator assembly and a rotor assembly of the type which includes a rotor having a longitudinal axis of symmetry and arrays of rotor blades extending outwardly from the rotor, each array being spaced axially from an adjacent array leaving an axial space therebetween, comprising the steps of:

forming an inner case which includes at least two arcuate segments extending longitudinally, each arcuate segment engaging a portion of two or more arrays of stator vanes, the stator vanes of each arcuate segment extending inwardly from the arcuate segment, the arrays of stator vanes being spaced axially one from another leaving an axial space therebetween;

positioning each arcuate segment of the inner case radially outwardly of the rotor assembly such that the arcuate segments are circumferentially spaced one from another, the arrays of stator vanes are each aligned in opposing relationship to a corresponding gap between the arrays of rotor blades, and the arrays of rotor blades are each aligned in opposing relationship to a corresponding space between the arrays of stator vanes;

assembling the inner case to the rotor assembly by moving the arcuate segments of the inner case inwardly toward the longitudinal axis of the rotor assembly such that the arrays of rotor blades and stator vanes are interdigitated and the arcuate segments of the inner case are circumferentially spaced one from another by a predetermined distance;

forming an annular sleeve having a longitudinal axis of symmetry;

assembling the annular sleeve to the inner case and rotor assembly by aligning the axis of symmetry of the rotor assembly with the axis of symmetry of the annular sleeve and causing relative movement between the annular sleeve and the inner case such that annular sleeve slidably engages each segment of the inner case and holds the segments in circumferential alignment.

2. The method for fabricating the flow directing device of claim 1 wherein the step of assembling the inner case to the rotor assembly includes the step of securing the arcuate segments one to another with a circumferentially extending tie.

3. For an axial flow gas turbine engine of the type having an annular flow path for hot working medium gases, and a flow directing assembly including two or more arrays of stator vanes, an improved flow directing assembly with comprises:

an inner case extending axially in the engine outwardly of the working medium flow path, formed of a plurality of arcuate segments circumferentially adjacent one to another which are axially continuous, each of which supports a portion of at least two arrays of stator vanes;

an annular sleeve of circumferentially continuous material outwardly of the inner case having a means for holding the segments in circumferential alignment which engages the segments of the inner case to hold the segments in circumferential alignment by attaching the segments of the inner case to the outer sleeve.

4. The flow directing assembly of claim 3 wherein the means for holding the segments in circumferential alignment of the sleeve is a plurality of flanges spaced axially one from another extending circumferentially about the interior of the case and wherein each segment of the inner case includes a plurality of flanges, each flange extending circumferentially about the segment and extending outwardly to slidably engage in the circumferential direction a corresponding flange of the sleeve.

5. The flow directing assembly of claim 4 wherein each flange of the inner case has gaps interrupting the circumferential continuity of the flange to decrease the hoop strength of the flange.

6. The flow directing assembly of claim 5 which further includes a means for sealing extending circumferentially between adjacent segments of the inner case.

7. The flow directing assembly of claim 5 which further includes a ring for preventing rotative movement of a segment of the inner case with respect to the annular sleeve, the ring engaging the sleeve at a plurality of spline-type connections and engaging said segment of the inner case at an inner spline-type connection wherein the circumferential portions of the segment of the inner case on either side of the inner spline-type connection are free to move circumferentially with respect to the sleeve.

8. The flow directing assembly of claim 1, claim 2, claim 3, claim 4, or claim 5 wherein the annular sleeve is formed of axially continuous material.

9. The flow directing assembly of claim 3, claim 4, claim 5, claim 6 or claim 7 wherein the sleeve has a large diameter end and a small diameter end and wherein each flange on the sleeve is radially outward of any flange on the inner case which is disposed entirely between said flange on the sleeve and the small diameter end.

10. The flow directing assembly of claim 3, claim 2, claim 5, claim 6 or claim 7 wherein the sleeve has a large diameter end and a small diameter end and wherein each flange on the annular sleeve has a groove which faces the large diameter end and which is adapted to receive a corresponding flange of the inner case.

11. The invention of claim 7 wherein the ring is formed of a plurality of segments.

* * * * *